US006111182A

United States Patent [19]

Takahashi

[11] Patent Number: 6,111,182

[45] Date of Patent: Aug. 29, 2000

[54] SYSTEM FOR REPRODUCING EXTERNAL AND PRE-STORED WAVEFORM DATA

[75] Inventor: Shigeru Takahashi, Shizuoka-ken, Japan

[73] Assignee: Roland Corporation, Los Angeles, Calif.

[21] Appl. No.: 09/237,872

[22] Filed: Jan. 27, 1999

[30] Foreign Application Priority Data

Apr. 23, 1998 [JP] Japan ..... 10-129455

[51] Int. Cl.[7] ..... G10H 7/00

[52] U.S. Cl. ..... 84/609

[58] Field of Search ..... 84/603–607, 609–614, 84/634–643, DIG. 29

[56] References Cited

U.S. PATENT DOCUMENTS

| | | | |
|---|---|---|---|
| Re. 34,913 | 4/1995 | Hiyoshi et al. | 84/603 |
| 4,614,983 | 9/1986 | Usami | 84/609 X |
| 4,667,556 | 5/1987 | Hanzawa et al. | 84/603 |
| 4,672,876 | 6/1987 | Sugiyama et al. | 84/1.03 |
| 4,681,008 | 7/1987 | Morikawa et al. | 84/1.28 |
| 5,243,125 | 9/1993 | Yamaguchi | 84/745 |
| 5,247,128 | 9/1993 | Suzuki | 84/611 |

FOREIGN PATENT DOCUMENTS

| | | |
|---|---|---|
| 63-62759 | 12/1986 | Japan . |
| 05120847 | 5/1993 | Japan . |
| 06195071 | 7/1994 | Japan . |
| 06230770 | 8/1994 | Japan . |
| 06348254 | 12/1994 | Japan . |
| 07168569 | 7/1995 | Japan . |
| 7-36389 | 8/1995 | Japan . |
| 2528586 | 12/1996 | Japan . |
| 09022288 | 1/1997 | Japan . |
| 09146554 | 6/1997 | Japan . |
| 10049166 | 2/1998 | Japan . |

OTHER PUBLICATIONS

Roland Corporation, *R–8 Human Rhythm Composer*, Owner's Manual, 1988, pp. 3–5, 11, 27, 58, 61–64.

Roland Corporation, *R–8 Human Rhythm Composer*, Owner's Manual, 1988, pp. 3–5, 11, 14–15, 17, 40–42.

Roland Corporation, *Digital Studio Workstation, VS–880*, Owner's Manual, 1996, pp. 5–7, 10–13, 22.

Roland Corporation, *JV–2080, 64 Voice Synthesizer Module, 3x EFX 8x Expansion*, Owner's Manual, 1996, pp. 4, 5, 12–14, 63–66, 70, 71, 76.

Roland Corporation, Paul D. Lehram, *Roland S–770 Digital Sampler with SYS–772 Version 2.0 Operating System*, 1991, Table of Contents, pp. 76, 83–93.

*Primary Examiner*—Stanley J. Witkowski
*Attorney, Agent, or Firm*—Foley & Lardner

[57] ABSTRACT

A system for editing and reproducing sounds according to pre-stored waveform data and recorded waveform data is disclosed. Pre-stored waveform data including timing information and musical tones are stored in memory. Musical tone waveform data including timing information from external sources such as electronic musical instruments, non-electronic musical instruments, and voices can also be stored in memory. The waveform data stored in memory can be edited before it is sequentially read out and a musical tone signal is reproduced.

12 Claims, 8 Drawing Sheets

| INFORMATION NUMBER | MUSICAL TONE WAVEFORM DATA | START POINT | LOOP POINT | END POINT | LOOP | READ-OUT START TIME | READ-OUT CONTINUATION TIME |
|---|---|---|---|---|---|---|---|
| 1 | | | | | | | |
| 2 | | | | | | | |
| 3 | | | | | | | |
| 4 | | | | | | | |

FIG. 3

SYSTEM FOR REPRODUCING EXTERNAL AND PRE-STORED WAVEFORM DATA

RELATED APPLICATION

This application claims priority to Japanese patent applications Heisei 10-129455 filed Apr. 23, 1998, which has been assigned to the applicant and is incorporated herein.

FIELD OF THE INVENTION

The present invention is directed to an electronic musical instrument and, more specifically, embodiments of the instant invention are directed to an electronic musical instrument, wherein the musical instrument is configured to store information that indicates the timing of the musical tone generation.

BACKGROUND OF THE INVENTION

For some time, electronic musical instruments have been known that, together with a so-called automatic performance system and generating musical tone signals in response to the operation of a performance operator, such as a key or a pad, store, in order, the information that indicates the timing for the generation of the musical tone signals and, by the reproduction in order of the information that has been stored, are able to generate musical tone signals that are based on the reproduced information.

However, with the electronic musical instruments of the past such as those described above, although it is possible to store information that indicates the timing for the generation of the musical signals based on the operation of the performance operators, it has not been possible to store performed sounds from the performance of musical instruments other than electronic musical instruments, such as drums and guitars.

In general, in the performance of music, performances by electronic musical instruments and musical instruments other than electronic musical instruments such as ensemble playing, frequently occurs. However, with the electronic musical instruments of the past such as those described above, nothing but the information that indicates the timing for the generation of the musical sound signals from the performance of the electronic musical instruments could be stored and, when the stored information was reproduced, only an extremely unsatisfactory musical expression could be obtained.

If a system that records the performed sounds such as, for example, a tape recorder or a hard disk recorder is employed, it is possible to record both the performed sounds that are generated by the performance of the electronic musical instruments and the performed sounds that are played by the musical instruments other than the electronic musical instruments. However, because the information that indicates the timing for the generation of the musical tone signals, which is based on the performance of the electronic musical instrument, is not stored, it has not been possible to subsequently edit the information.

More specifically, with the electronic musical instruments of the past, as well as with tape recorders or hard disk recorders, the storage of performed sounds that are played by musical instruments other than electronic musical instruments, in conjunction with the storage of the information that indicates the timing for the generation of the musical tone signals that are based on the performance of the electronic musical instruments, has not been considered at all.

Embodiments of the present invention take into consideration such situations as those described above. At least one objective of embodiments of the instant invention is to present an electronic musical instrument in which the storage of the information for indicating the timing for the generation of musical tones originate from such things as the operation of a performance operator or a musical instrument digital interface ("MIDI") input. Moreover, by means of making possible the storage of the information that indicates the timing for the generation of the musical tones which is the timing for the read-out of the appropriate performed sounds, together with the storage of the performed sounds from the playing of musical instruments other than electronic musical instruments, such as drums and guitars, a satisfactory musical expression can be obtained when the information that has been stored is reproduced and further, it is possible to edit the information.

SUMMARY OF THE DISCLOSURE

Embodiments of the present invention have an input means in which external musical tone signals are input; at least one or a plurality of waveform data storage means in which the musical tone waveform data are stored; a performance information generation means in which performance information that indicates the production and stopping of musical tones is generated; at least one or a plurality of musical tone generation timing information storage means in which the musical tone generation timing information is stored; a first storage control means in which, in accordance with the performance information that has been generated by the performance information generation means, the musical tone generation timing information that indicates the generation timing of the performance information is stored in the musical tone generation timing information storage means, a second storage control means in which, together with the storage of musical tone waveform data in the musical tone waveform data storage means based on the external musical tone signal that has been input in the input means, the musical tone generation timing information that indicates the storage timing of the musical tone waveform data is stored in the musical tone generation timing information means; a reproduction means in which the musical tone generation timing information that is stored in the musical tone generation timing information storage means is reproduced in the timing order that is indicated by the musical tone generation timing information; and a musical tone production means in which, by means of the read-out of the musical tone waveform data that correspond to the external musical tone signal which is stored in the musical tone waveform data storage means in accordance with the musical tone generation timing information that is based on the external musical tone signal that has been reproduced by the reproduction means, a musical tone signal is produced that corresponds to the external musical tone signal which has been input in the input means.

Thus, in accordance with embodiments of the present invention, it is possible to store the musical tone generation timing information that indicates the generation timing of the appropriate performance information that is in accordance with the performance information which has been generated by the performance information generation means in the musical tone generation timing information storage means. Moreover, together with being able to store musical tone waveform data that are based on external musical tone signals that have been input in the input means in the musical tone waveform data storage means, it becomes possible to store the musical tone generation timing information that indicates the stored timing of the musical tone waveform data in the musical tone generation timing information storage means. Moreover, for the performance information generation means that has been described above, in addition to such performance operators as keys, pads etc., there are also those that include an external MIDI input.

In addition, in embodiments of the present invention musical tone waveform data are stored in advance in the musical tone waveform data storage means, together with the storage of the musical tone waveform data that are based on the external musical signal and wherein, in the musical tone production means, musical tone signals are produced that correspond to the performance information from the read-out of the musical tone waveform data that have been stored in advance in the musical tone waveform data storage means in accordance with the performance information that has been generated by the performance information generation means. In addition, musical tone signals are produced that correspond to the musical tone generation timing information that is based on the performance information from the read-out of the musical tone waveform data that have been stored beforehand in the musical tone waveform data storage means in accordance with the musical tone generation timing information that is based on the performance information which has been reproduced by the reproduction means.

Thus, in accordance with embodiments of the present invention, it is possible to produce musical tone signals that correspond to the read-out of the musical tone waveform data that have been stored in advance in the musical tone waveform data storage means in accordance with the performance information that has been generated by the performance information generation means. In addition, it is possible to produce musical tone signals that correspond to the musical tone generation timing information based on the performance information from the read-out of the musical tone waveform data that have been stored in advance in the musical tone waveform data storage means in accordance with the musical generation timing information that is based on the performance information that has been reproduced by the reproduction means.

Further, in preferred embodiments of the present invention in the musical tone generation timing information storage means, there are a plurality of tracks and a track designation means, wherein any optional first track is designated for the storage of the musical tone generation timing information from the first storage control means or the second storage control means of the musical tone generation timing information storage means wherein in the reproduction means, a second track of musical tone generation timing information that differs from the first track of the musical tone generation timing information storage means is reproduced. Thus, in accordance with embodiments of the present invention, while the musical tone signals that are based on the musical tone generation timing information that has been stored in the second track are produced, the musical tone generation timing information that indicates the generation timing of the appropriate performance information, in accordance with the performance information that has been generated by the performance information generation means or the musical tone generation timing information from the external musical tone signal, is stored in the first track.

In addition, preferred embodiments of the present invention include a storage mode designation means in which any one from at least the first storage mode and the second storage mode is designated. In the first storage control means, when the first storage mode has been designated by the storage mode designation means, the musical tone generation timing information is stored in the first track that has been designated by the track designation means. In the second storage control means, when the second storage mode has been designated by the storage mode designation means, together with the storage of the musical waveform data in the musical tone waveform data storage means, the musical tone generation timing information is stored in the designated second track by the track designation means. In the reproduction means, the musical tone generation timing information that has been stored in the first track of the musical tone generation timing information storage means and the musical tone generation timing information that has been stored in the second track of the musical tone generation timing information storage means are synchronized and reproduced. Thus, in accordance with embodiments of the present invention, when the first storage mode is designated, the musical tone generation timing information is stored in the first track and, when the second storage mode is designated, together with the storage of the musical tone waveform data in the musical tone waveform storage means, the musical tone generation timing information is stored in the second track. The musical tone generation timing information that has been stored in the first track and the musical tone generation timing information that have been stored in the second track are synchronized and can be reproduced.

In addition, in embodiments of the present invention in the second storage control means, the storage is started from any arbitrarily designated storage timing. In accordance with the storage of the musical tone waveform data which is based on the external musical tone signal, the musical tone generation timing information that is indicated by the storage timing that has been designated arbitrarily is stored in the musical tone generation timing information storage means. Thus, in accordance with embodiments of the present invention, it is possible to store the musical tone generation timing information that indicates the stored timing that has been arbitrarily designated in the musical tone generation timing information storage means.

Because the present invention is configured in the manner described above, it exhibits numerous advantages. For instance, one advantage is that it is possible to store the information that indicates the generation timing of the musical tones from the operation of the performance operator. Moreover, together with the storage of performance sounds from the performance of musical instruments other than electronic musical instruments, such as drums and guitars, it is possible to store the information that indicates the timing for the generation of musical tones which is the timing that is read out for the performance sounds. When the appropriate information that has been stored is reproduced, it becomes possible to obtain a satisfactory musical expression. Further, it is possible to perform functions such as the editing of the information that has been stored.

The above and other advantages of embodiments of this invention will be apparent from the following more detailed description when taken in conjunction with the accompanying drawings. It is intended that the above advantages can be achieved separately by different aspects of the invention and that additional advantages of this invention will involve various combinations of the above independent advantages such that synergistic benefits may be obtained from combined techniques.

BRIEF DESCRIPTION OF THE DRAWINGS

The detailed description of preferred embodiments of the invention will be made with reference to the accompanying drawings, wherein like numerals designate corresponding parts in the figures.

FIG. 3 is a diagram that represents the configuration of the musical tone generation timing information memory and the display mode for the musical tone generation timing information.

DETAILED DESCRIPTION OF PREFERRED EMBODIMENTS

Below, a detailed explanation will be given of a preferred embodiment of an electronic musical instrument in accordance with the present invention with reference to the attached figures.

Figure 1:
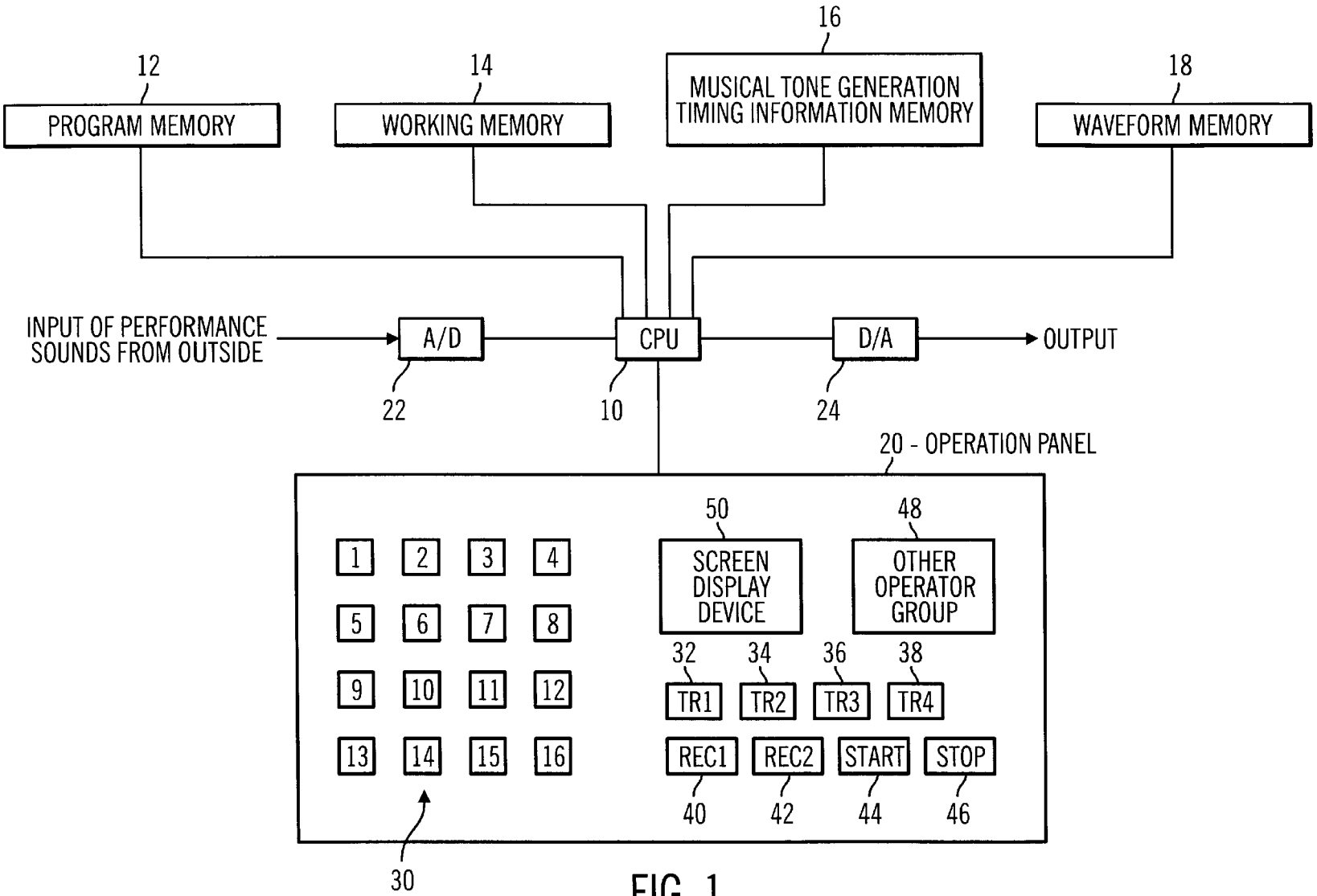
FIG. 1 is a block structural diagram that shows the overall configuration of an embodiment of the electronic musical instrument in accordance with a preferred embodiment the present invention.

FIG. 1 shows a block structural diagram that depicts the overall configuration of a preferred embodiment of the electronic musical instrument in accordance with the present invention. Preferred embodiments comprise a CPU 10, a program memory 12, a working memory 14, a musical tone generation timing information memory 16, (discussed below) which stores the musical tone generation timing information, a waveform memory 18, (discussed below) which stores the musical tone waveform data, an operation panel 20, an analog to digital converter (A/D) 22 and a digital to analog converter (D/A). The electronic musical instrument is configured such that a central processing unit (CPU) 10 is employed for the control and regulation of the overall operation.

The operation panel 20 comprises pads 30, which include 16 push-buttons that are designated by the numbers 1 to 16 in FIG. 1, a track 1 (TR1) operator 32, a track 2 (TR2) operator 34, a track 3 (TR3) operator 36 and a track 4 (TR4) operator 38, whereas tracks 1–4 operators designate the track in which the performance is stored. The operator panel 20 further includes a storage 1 (REC1) operator 40 for the designation of the first storage mode for the storage of the performance based on the operation of the pads 30 as the mode for the electronic musical instrument; a storage 2 (REC2) operator 42 for the designation of the second storage mode in which the performed sounds from outside are stored as the mode for the electronic musical instrument; a starting (START) operator 44 for the designation of the start of reproduction or storage; and a stopping (STOP) operator 46 for stopping storage or reproduction and restoring the pad performance mode from the first storage mode, the second storage mode or the reproduction mode as the mode for the electronic musical instrument. The operator panel 20 further includes an operator group 48 that is used for such things as changing each of the settings and editing the musical tone generation timing information that has been stored; and a screen display device 50 that carries out the display of such things as the setting state due to the operation of each of the various operators that have been described above and for the editing of the musical tone generation timing information.

The operating state of each of the various operators that are described above is monitored by the CPU 10. Further, the display contents of the screen display device 50 are controlled by the CPU 10.

In embodiments of this electronic musical instrument, when a pad 30 on the operation panel 20 is operated, the performance information that indicates the operation of the pad has been done is generated. In addition, embodiments of this electronic musical instrument include the analog to digital converter (A/D) 22, wherein the analog format performance sounds that have been externally input are digitized by the analog to digital converter (A/D) 22 such that they can be introduced into the CPU 10.

A further explanation will be given concerning embodiments of each structural element of the electronic musical instrument that has been described above. First, the program for the CPU 10 is stored in advance in the program memory 12. In addition, the working memory 14 is the memory used for working by the CPU 10, and wherein each of the various settings are stored in the working memory 14.

In addition, in accordance with the performance information that is generated by the operation of a pad 30, in the musical tone generation timing information memory, the musical tone generation timing information that indicates the read-out start time of the musical tone waveform data and the read-out stop time of the musical tone waveform data are stored, wherein this information indicates the timing of the generation of the appropriate performance information. In conjunction with this, the musical tone generation timing information that indicates the storage start time and the storage stop time for performed sounds that have been externally input is recorded. The musical tone generation timing information from this is apportioned to and stored on the four tracks.

For this embodiment, an explanation has been given of an example in which storage regions are established on each track for the musical tone generation timing information. However, as long as it is possible to identify what musical tone generation timing information is on which track (for example, the addition of identifying information that indicates, for each piece of musical tone generation timing information, which part of the musical tone generation timing information is identified with which track), the musical tone generation timing information may be stored, as a matter of course, in common storage regions on all the tracks.

In addition, in the waveform memory 18, together with the advance storage of 100 varieties of musical tone waveform data, the musical tone waveform data for the performed sounds that have been externally input are also stored. To aid in the management of the 100 varieties of musical tone waveform data that have been stored in advance, the 100 varieties of musical tone waveform data has been assigned by the numbers 1 to 100 to each of them respectively. Similarly, the musical tone waveform data for the performed sounds that have been externally input are managed by the assignment of the numbers 101 and up in the order in which they are input. By means of the operation of the other operator 48 on the operation panel 20, it is possible to set any optional musical tone waveform data to correspond with each of the 16 pads 30.

In preferred embodiments, the musical tone waveform data that are stored in advance in the waveform memory 18 typically are sounds such as those that are the result of a single or a variety of musical instruments, wherein the sounds are obtained by the playing over some period of time, for example, the time used by two bars of a certain tune, which is known as a so-called "phrase." However, musical instrument sounds that are obtained in those cases where a wind instrument has been sounded only once or in those cases where a stringed instrument is plucked only once can also be recorded. Further, voices, such as singing voices or shouts, and the sound of rain can also be recorded. In other words, in the waveform memory 18, any sort of sound data may be stored as the musical tone waveform data and there is no particular requirement that musical instrument sound data be stored. In addition, with regard to performed sounds that are externally input, recorded sounds include, but are not limited to, performed sounds such as those of drums and guitars.

In preferred embodiments of the electronic musical instrument, the musical tone waveform data that have been stored in the waveform memory 18 are read out by the CPU 10. The musical tone waveform data that are read out are converted to an analog format by the digital to analog converter 24, output as a musical tone signal and emitted into space as sounds that can be heard through a sound system (not shown in the figure) that can be composed of, but not limited to, amplifiers and speakers.

Figure 2:
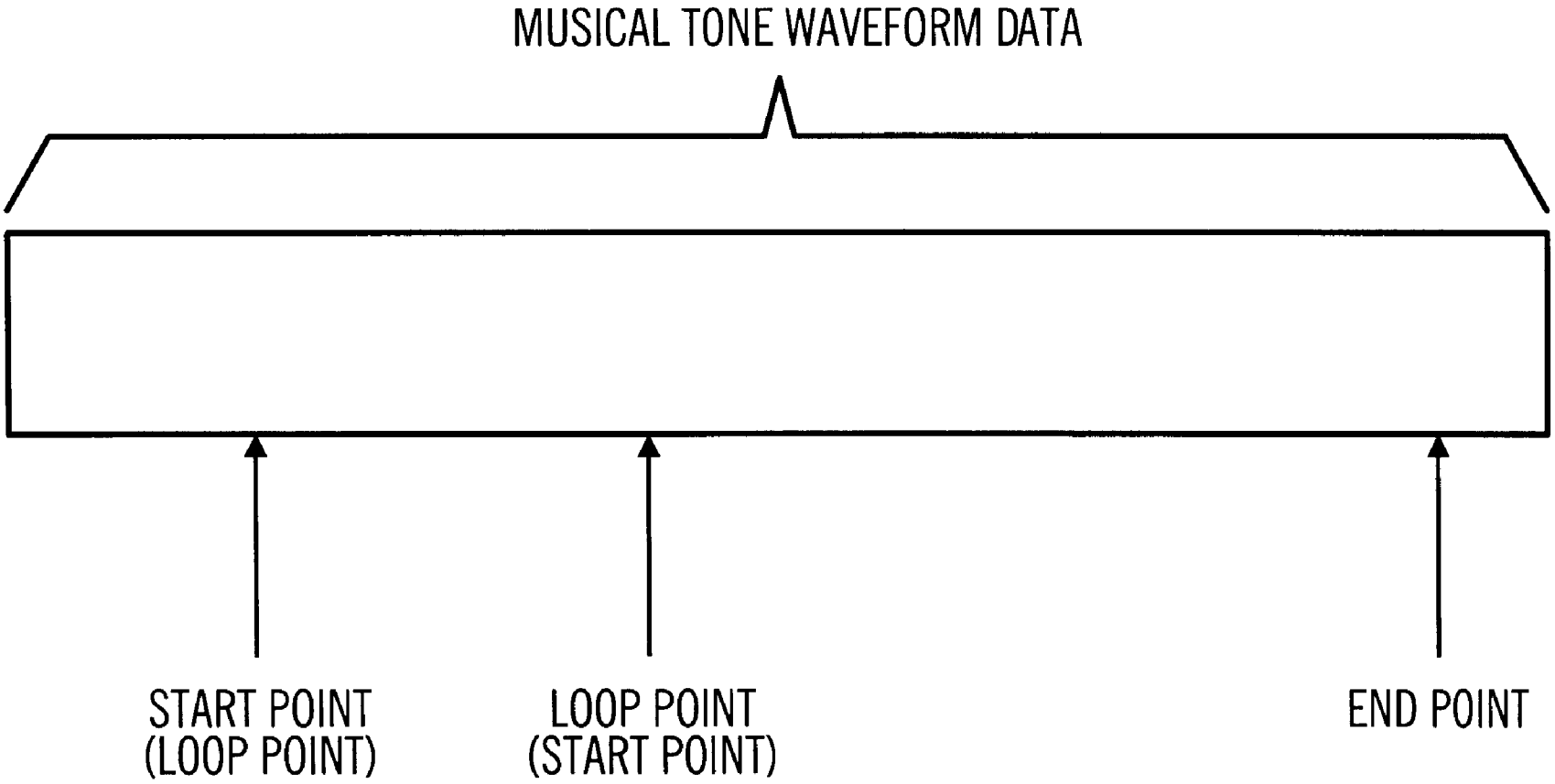
FIG. 2 is a diagram that represents, in concept, the start point, the end point and the loop point that are set in the musical tone waveform data.

An explanation will now be given concerning the musical tone waveform data that are stored in the waveform memory 18. For each of the pieces of musical tone waveform data, as is shown in FIG. 2, the start point, end point and loop point, which will be explained below, are set in advance. In addition, the determination of whether the loop read-out will be performed is set in advance. Further, it is possible to change each of these settings for the musical tone waveform data as desired by means of the operation of the other operator 48.

The start point is any means that indicates the starting location for the read-out of the musical tone waveform data in accordance with the operation of a pad 30 or the reproduction of the musical tone generation timing information. If, by means of the operation of the other operator 48, the start point is set at an arbitrary location in the musical waveform data, for example, in the middle of the musical tone waveform data, it is also possible to start the readout of the musical tone waveform data from the arbitrarily set location, such as, the middle.

The end point is any means that indicates the repeat location for the musical tone waveform data in those cases where a loop read-out is carried out in which a specified segment is repeatedly read out. If, by means of the operation of the other operator 48, the end point is set at an arbitrary location in the musical tone waveform data, for example, in the middle of the musical tone waveform data, when the musical tone waveform data are read out up to the arbitrarily set location, such as, the middle, a repeated read-out returning to the loop point (to be discussed later) becomes possible.

The loop point is an indicator of the first sound in the second and subsequent repetitions. In other words, the loop point indicates the loop read-out starting location in those cases where a loop read-out is performed. Thus, in those cases where a loop read-out is carried out, when the musical tone waveform data are read out up to the end point, there is a return to the loop point and the read-out of the musical tone waveform data is continuously carried out, thereby repeating the operation.

The start point, end point and loop point are set so as to be designated by information that indicates a position relative to the start of the musical tone waveform data. The loop point location may be at a position that is before, after, or the same as, the start point. However, the location of the end point is required to be set after both the position of the start point and the position of the loop point.

An explanation will now be given concerning an overview of the operation of each of the modes of the electronic musical instrument. First, in the pad performance mode, in accordance with the operation of the pad 30, the musical tone waveform data that correspond to the pad 30 that has been operated is read out from the waveform memory 18 under the control of the CPU 10 and a musical tone signal is produced. Specifically, the read-out of the musical tone waveform data is commenced in accordance with the depression or the pressure on the pad 30 and, when the pressure on the pad 30 is released, that is, canceled or terminated, the read-out of the musical tone waveform data stops. In those cases where a loop read-out is not performed, when the musical tone waveform data are read out up to the end point before the cancellation of the pressure on the pad 30, the read-out of the musical tone waveform data stops at the end point. On the other hand, in those cases where a loop read-out is carried out, when the musical tone waveform data are read out up to the end point before the cancellation of the pressure on the pad 30, the read-out returns to the loop point and is continued with a repetitive operation.

In addition, in those cases where the storage of the performance is carried out, either the storage 1 (REC1) operator 40 or the storage 2 (REC2) operator 42 is operated and either the storage mode 1 or the storage mode 2 is designated as the storage mode. Following this, any one of the track operators, namely, the track 1 (TR1) operator 32, the track 2 (TR2) operator 34, the track 3 (TR3) operator 36 or the track 4 (TR4) operator 38 is operated and a track is designated as the object of the storage. When a track is designated as the storage object, it is only possible to designate one track as the track that is object of the storage at a given time.

After this, when the starting (START) operator 44 is operated, the storage of the performance is started and, when the stopping (STOP) operator 46 is operated, the storage of the performance is stopped. With regard to the tracks that have not been made the objects of the storage, in those cases where musical tone generation timing information has already been stored on the non-designated track, the reproduction of the musical tone generation timing information is begun from the initial point of the track synchronously with the start of the storage. In the same manner as in the case of the reproduction mode (discussed later), the read-out of the musical tone data from the non-designated track is carried out in accordance with the musical tone generation timing information that has been reproduced. Thus, in the first storage mode or the second storage mode, while the musical tone generation timing information of the track that has already had musical tone generation timing recorded is reproduced and a musical tone signal is generated in accordance with this, it is possible to store a new performance on another track synchronously with the reproduction.

In the first storage mode, the same as in the pad performance mode, the read-out of the musical tone waveform data is carried out in accordance with the pad operation and, together with the generation of the musical tone signal, the musical tone generation time information that indicates such things as the read-out start time of the musical tone waveform data and the read-out stop timing of the musical tone waveform data is stored in the musical tone generation timing information memory 16.

In addition, in the second storage mode, together with the storage of the performed sounds from outside in the waveform memory 18, the musical tone generation timing information that indicates such things as the timing for the start of storage and the timing for the stopping of storage is stored in the musical tone generation timing information memory 16. The timing for the starting of storage and the timing for the stopping of storage are equivalent to the read-out start time for the musical tone waveform data and the read-out stop time for the musical tone waveform data, respectively.

However, when the starting (START) operator 44 is operated in the pad performance mode, it becomes the reproduction mode. With regard to four tracks of the musical tone generation timing information memory 16, the read-out of the musical tone generation timing information is started from the beginning synchronously with each other. When the stopping (STOP) operator 46 is operated, the read-out of the musical tone generation timing information from the musical tone generation timing information memory 16 is stopped. In other words, in the reproduction mode, the musical tone generation timing information of the four tracks which are stored in the musical tone generation timing information memory 16 are read out in order synchronously with each other. The read-out of the musical tone waveform data is begun in accordance with the corresponding read-out start time for the musical tone waveform data that the musical tone generation timing information indicates and the read-out of the musical tone waveform data is stopped in accordance with the corresponding read-out stop time for the musical tone waveform data that the musical tone generation timing information indicates. In those cases where the carrying out of a loop read-out is designated in the reproduction mode, when the musical tone waveform data are read out to the end point, there is a repetitive operation in which the read-out returns to the loop point and is continued.

An explanation will now be given concerning the musical tone generation timing information memory 16 with reference to FIG. 3. In the musical tone generation timing information memory 16, the storage regions that are shown in FIG. 3 are established for each track.

For the storage region of each track, the storage regions are established with the appended information numbers 1, 2, 3 . . . in time order, and one group of musical tone generation timing information is stored in each storage region.

The storage of the musical tone generation timing information in the musical tone generation timing information memory 16 is started in accordance with the operation of the starting (START) operator 44, wherein the musical tone generation timing information is stored in order to the storage regions having the appended information numbers 1, 2, 3 . . . , and so forth.

One group of musical tone generation timing information is configured from seven pieces of data including the "musical tone waveform data," the "start point," the "loop point," the "end point," the "loop," the "read-out start time" and the "read-out continuation time."

Descriptions will be given of these seven pieces of data. The "musical tone waveform data" are the data that indicate the musical tone waveform data that are to be read out and stores the location of the number that is appended to each group of musical tone waveform data.

In the "start point," "loop point," "end point" and "loop," each of the settings regarding start point, loop point, end point and whether the loop read out will be performed for the musical tone waveform data are respectively copied. The "read-out start time" is the portion of data that indicates the starting time for the read-out of the musical tone waveform data and the "read-out continuation time" is the portion of data that indicates the time from the start to the end of the read-out of the musical tone waveform data. When the point at which the starting (START) operator 44 is operated after the first storage mode or the second storage mode has been selected, in other words, the point at which the storage has been started, the reference time, the "read-out start time" indicates the time that passes from the point of the reference time.

In addition, in the first storage mode, with regard to the tracks that are the objects of storage, it is possible to read out only one musical tone waveform data at a time and, during the time that certain musical tone waveform data are being read out in accordance with the operation of a certain pad 30, the operation of another pad 30 will have no effect. In other words, in this electronic musical instrument, two or more pieces of musical tone waveform data cannot be read out at the same time.

Although a further detailed explanation will be given later regarding the method of storage to the musical tone generation timing information memory 16 with reference to the flow charts that are shown in FIG. 4 through FIG. 8, it will be briefly described here. In the first storage mode, in accordance with the performance information that is generated by the operation of a pad 30, the group of musical tone generation timing information that corresponds to the operation of the pad 30 is stored in the track of the musical tone generation timing information memory 16 that is the object of storage.

In other words, when the read-out of the musical tone waveform data has been started by the pressure on the pad 30, a new single group of musical tone generation timing information is added and the number that indicates the musical tone waveform data that correspond to the pad 30 is stored as the "musical tone waveform data." Each of the settings regarding the start point, loop point, end point and whether to carry out the loop read-out for the musical tone waveform data that correspond to the pad 30 is copied to "start point," "loop point," "end point" and "loop", respectively, and, in addition, the time for the point of the start point is stored as the "read-out start time."

In addition, when the pressure on the pad 30 that corresponds to the musical tone waveform data, the read-out of which is being carried out, is canceled or when the read-out of the musical waveform data has been performed to the end point in those cases where a loop read out is not carried out, the time that has passed up to the point from the start of the readout is stored as the "read-out continuation time" for the most recent group of musical tone generation timing information.

On the other hand, in the second storage mode, together with the storage of performance sounds that have been externally input as the musical tone waveform data in the waveform memory 18, one group of musical tone generation timing information that indicates the start time and the stop time for the storage is stored in the track that is the object of storage in the musical tone generation timing information memory 16.

In other words, when the starting (START) operator 44 is operated and the starting of the storage is designated, the storage of the musical tone waveform data for the performance sounds that have been externally input in the waveform memory 18 is begun and a number is newly assigned to that musical tone waveform data. In addition, together with the setting of the start point and the loop point for that musical tone waveform data to zero, a setting is made to the effect that the loop read-out will not be carried out.

The number that has been newly assigned to the musical tone waveform data is stored as the "musical tone waveform data" of the musical tone generation timing information group and each of the settings for the start point, loop point and whether the loop read-out will be done that have been set for the musical tone waveform data are respectively copied to the "start point," "loop point" and "loop" of the musical tone generation timing information group. In addition, the storage starting point time, in other words, zero, is stored as the "readout start time" of the musical tone generation timing information group.

When the stopping (STOP) operator 45 has been operated and the stopping of the storage has been designated, the storage of the musical tone waveform data for the performance sounds that have been externally input in the waveform memory 18 is stopped and, together with the setting of the end point of the musical tone waveform data based on the difference between the final address and the starting address in the waveform memory 18 of the musical tone waveform data that have been stored, the "end point" of the musical tone generation timing information group is stored. In addition, the time that passes from the start of the storage until the stopping of the storage is stored as the "read-out continuation time" in the musical tone generation timing information group.

Next, a detailed explanation will be given concerning the processing in the first storage mode and the second storage mode related to the present invention with reference to the flow charts of FIG. 4 through FIG. 8. Incidentally, with regard to the pad performance mode and the reproduction mode, because neither is related to the present invention, detailed explanations for them have been omitted and they will only be described in summary.

Figure 4:
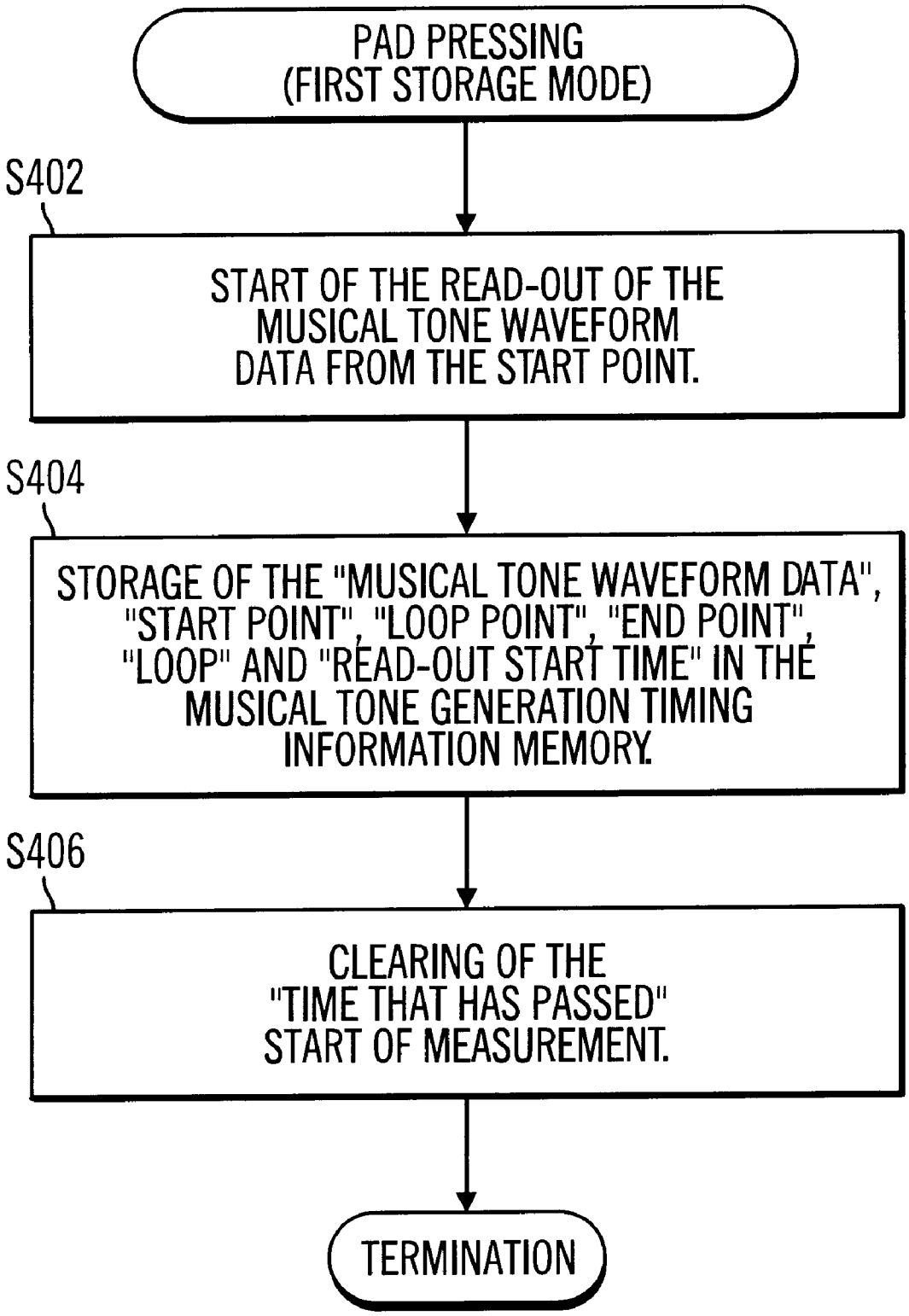
FIG. 4 is a flow chart for the pad pressing (first storage mode) routine in accordance with one preferred embodiment.

First, an explanation will be given concerning the processing that is performed when pressure is applied to any of the pads 30 during the storage in the first storage mode with reference to the flow chart for the pad pressing (first storage mode) routine that is shown in FIG. 4. In the pad pressing (first storage mode) routine, the read-out from the start point of the musical tone waveform data that corresponds to the pad 30 that has been pressed is begun (Step S402). Following this, by means of a separate process, which is not shown in the figure, that is executed for each sampling cycle, the reading advances for each sample of the musical tone waveform data toward the end point.

Continuing in Step S402, in the musical tone generation timing information group that follows the most recent musical tone generation timing information group that has previously been stored in the musical tone generation timing information memory 16, the number that indicates the musical tone waveform data that has begun to be read out in Step S402 is stored as the "musical tone waveform data." The settings for the start point, loop point, end point and whether to carry out the loop read-out for the musical tone waveform data are stored as the "start point," "loop point," "end point" and "loop". The time of the point for the start point is stored as the "read-out start time" (Step S404).

In addition, the value of the variable that indicates the "time that has passed" is cleared to zero, the counting of the variable is begun (Step S406) and the pad pressing (first storage mode) routine terminates. Following this, the variable that indicates the time that has passed is increased in increments of 1 by means of a separate process, which is not shown in the figure, that is executed at each specified period. The value of the variable that indicates the "time that has passed" is subsequently stored as the "read-out continuation time" in the musical tone generation timing information memory 16.

When any of the pads 30 has been pressed in the pad performance mode, within the process that is shown in FIG. 4, only the processing in which the read-out of the musical tone waveform data that correspond to the pad 30 that has been pressed is begun from the start point (Step S402) and is carried out.

Figure 5:
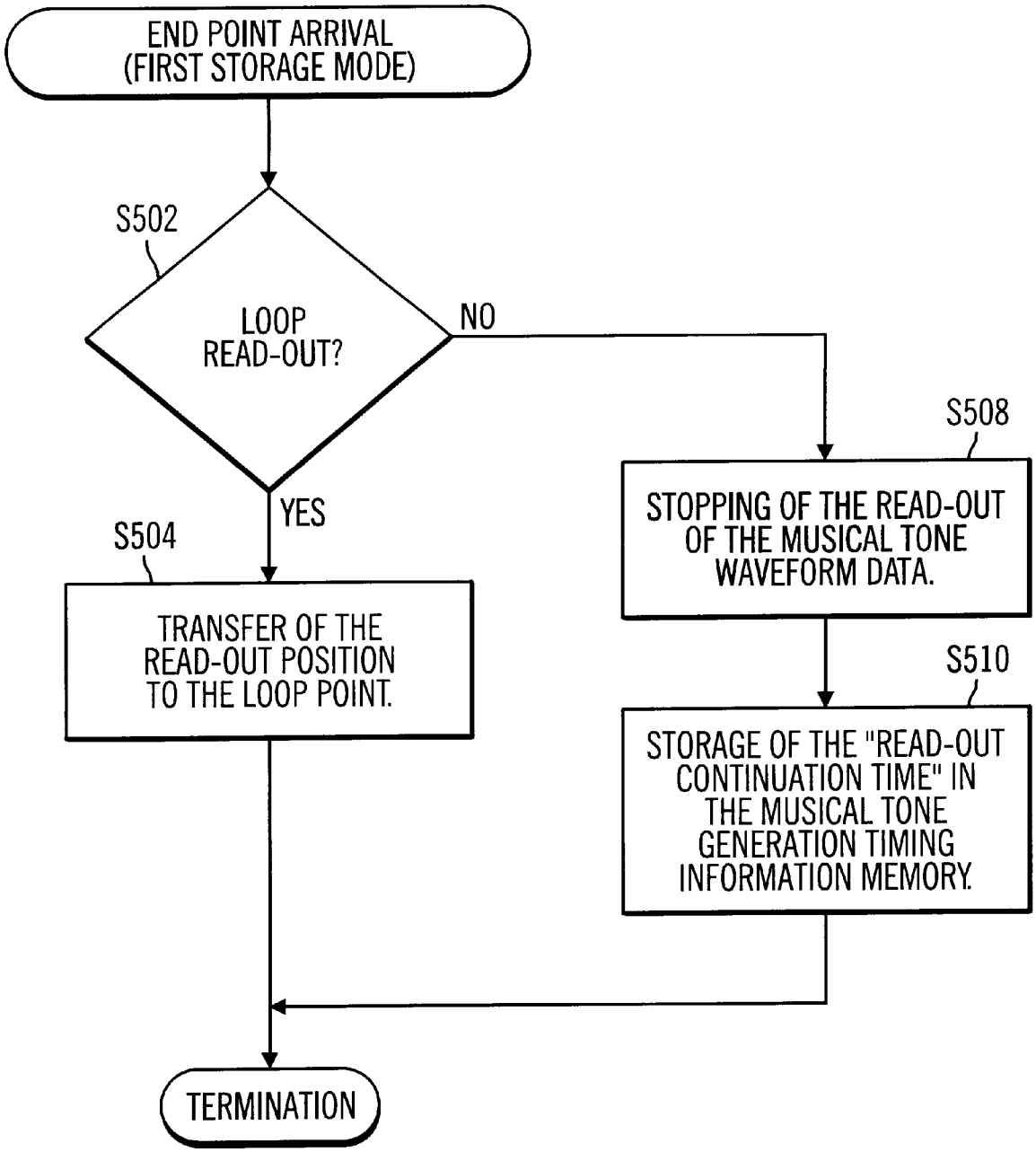
FIG. 5 is a flow chart for the end point arrival (first storage mode) routine in accordance with a preferred embodiment of the invention.

Next, an explanation concerning the process that is carried out when, during the storage in the first storage mode, the read-out position of the musical tone waveform data in the read-out arrives at the end point of the musical tone waveform data with reference to the flow chart for the end point arrival (first storage mode) routine that is shown in FIG. 5.

In the end point arrival (first storage mode) routine, a determination is made as to whether the carrying out of a loop read-out has been set for the musical tone waveform data the read-out position of which has arrived at the end point (Step S502).

In Step S502, in those cases where it is set so that a loop read-out is carried out, the read-out position of the musical tone waveform data, the read-out position of which has arrived at the end point, is transferred to the loop point (Step S504). By means of this, the musical tone waveform data the read-out position of which has arrived at the end point, is to be read out again from the loop point to the end point. When the processing of Step S504 is completed, the end point arrival (first storage mode) routine terminates.

On the other hand, in those cases where, in Step S502, a determination has been made that the carrying out of a loop read-out has not been set, the read-out of the musical tone waveform data, the read-out position of which has reached the end point, is stopped (Step S508). The value of the variable that indicates "time that has passed" is stored as the "readout continuation time" for the most recent musical tone generation timing information group of the musical tone generation timing information memory 16 (Step S510) and the end point arrival (first storage mode) routine terminates.

In the pad performance mode, when the read-out position of the musical tone waveform data during the read-out arrives at the end point of the musical tone waveform data, from within the processing that is shown in FIG. 5, only the processing excluding the processing in which the "read-out continuation time" is recorded in the musical tone generation timing information memory 16 is carried out.

Figure 6:
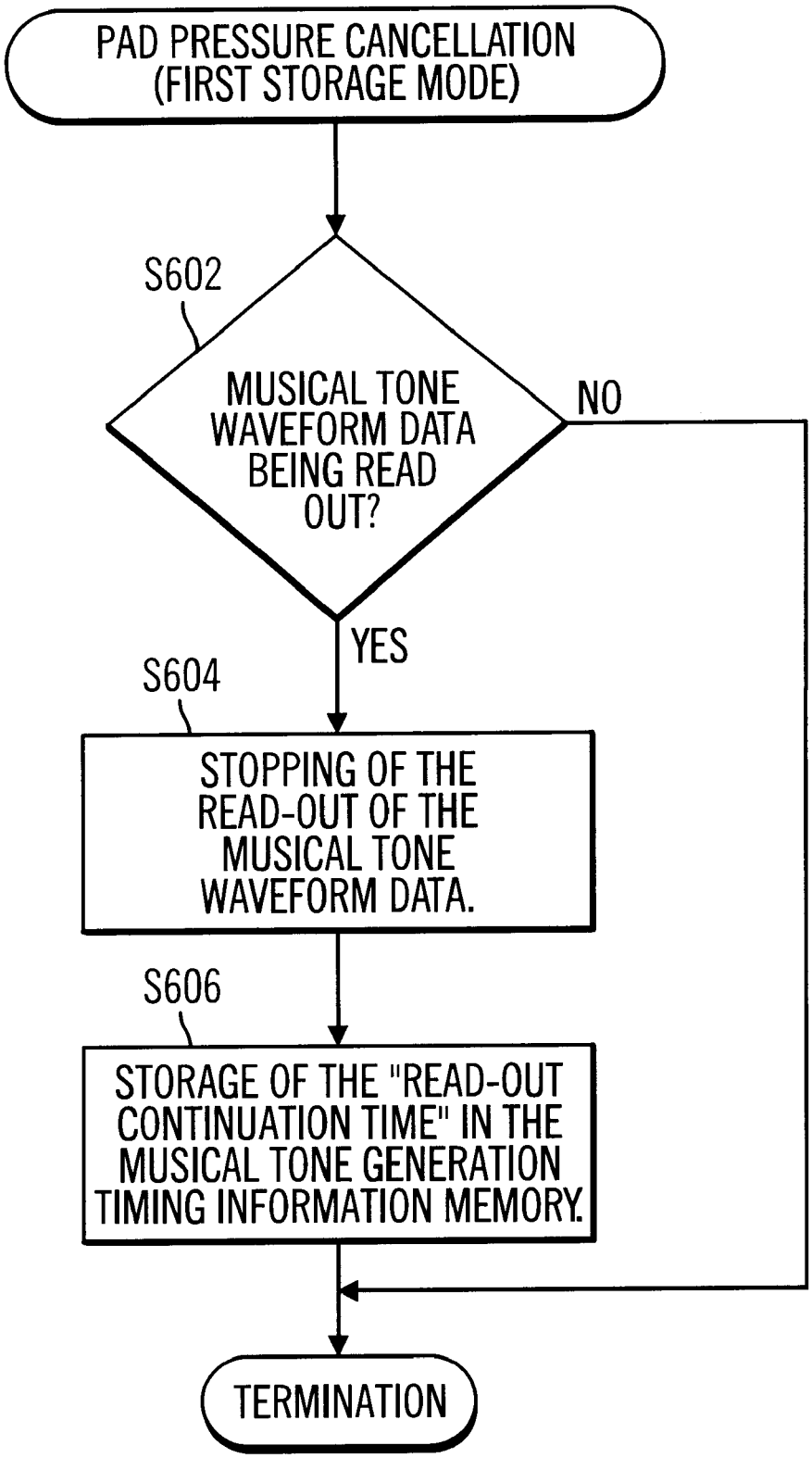
FIG. 6 is a flow chart for the pad pressure cancellation (first storage mode) routine in accordance with a preferred embodiment of the invention.

Next, an explanation will be given of the process that is carried out when the pressure that is applied on any pad 30 has been canceled during the storage in the first storage mode with reference to the flow chart for the pad pressure cancellation (first storage mode) routine that is shown in FIG. 6.

In the pad pressure cancellation (first storage mode) routine, a determination is made as to whether the musical tone waveform data that correspond to the pad 30, the pressure on which has been canceled, are something that are being read out (Step S602). In those cases where it has been determined that the musical tone waveform data that correspond to the pad 30 the pressure on which has been canceled are something that are being read out, the read-out of the musical tone waveform data is terminated (Step S604).

Following this, the value of the variable that indicates the "time that has passed" is stored as the "read-out continuation time" of the most recent musical tone generation timing information group in the musical tone generation timing information memory 16 (Step S606) and the pad pressure cancellation (first storage mode) routine is terminated.

On the other hand, in those cases where, in Step S602, it has been determined that the musical tone waveform data that correspond to the pad 30 the pressure on which has been canceled are something that are not being read out, the pad pressure cancellation (first storage mode) routine is terminated without any processing being carried out.

In the pad performance mode, when the pressure on any of the pads 30 is canceled, from within the processing that is shown in FIG. 6, only the processing which excludes the process of the storage of the "read-out continuation time" in the musical tone generation timing information memory 16 (Step S606) is carried out.

In addition, in those cases where, in the first storage mode, the stopping (STOP) operator 46 has been operated, the storage has been stopped and the reinstatement of the pad performance mode has been designated, up to which the musical tone generation timing information group has been stored in the musical tone generation timing information memory 16 and the pad performance mode is reinstated.

Figure 7:
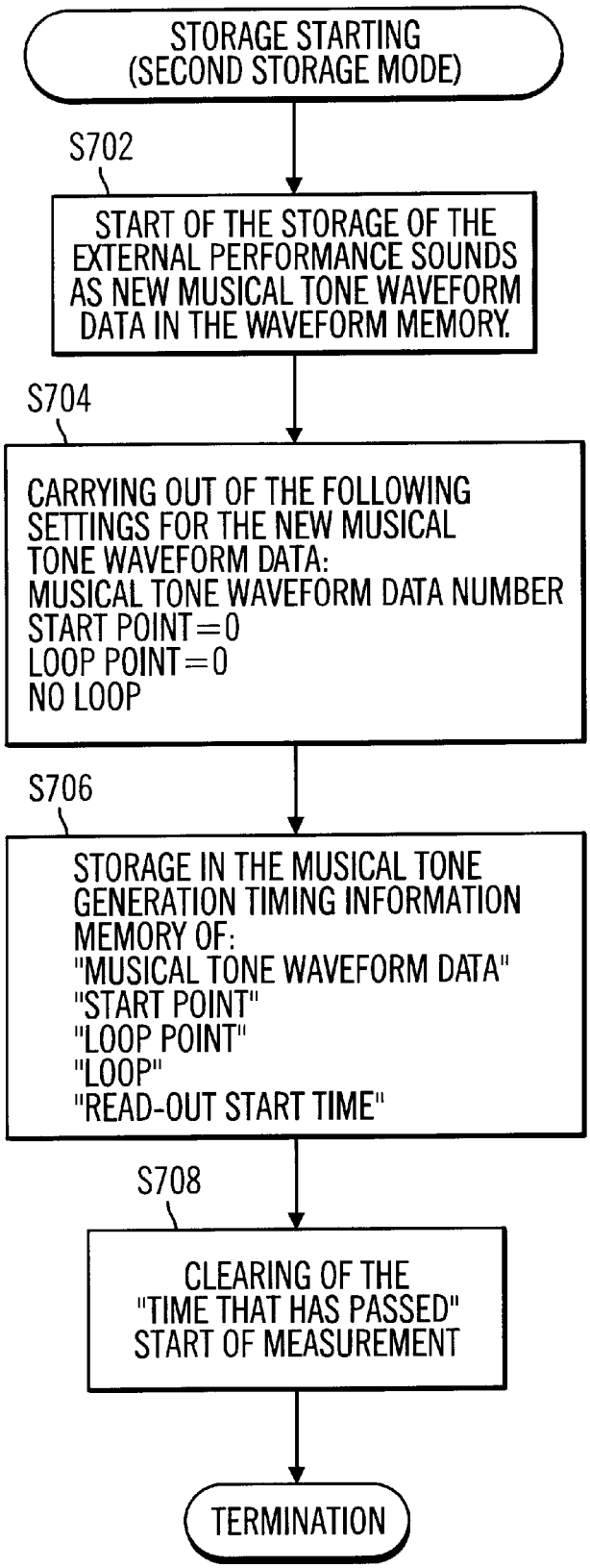
FIG. 7 is a flow chart for the storage starting (second storage mode) routine in accordance with a preferred embodiment of the invention.

Next, an explanation will be given of the process that is carried out in the second storage mode when the starting (START) operator 44 has been operated and the starting of storage has been designated with reference to the flow chart for the storage starting (second storage mode) routine that is shown in FIG. 7.

In the storage starting (second storage mode) routine, the storage of the performance sounds that have been externally input as new musical tone waveform data in the waveform memory is begun (Step S702). Following Step S702, a new number is assigned to the new musical tone waveform data. Further, the start point and the loop point are set to 0 and a setting to the effect that a loop read-out not be done is made (Step S704).

Following this, the number that has been newly assigned to the new musical tone waveform data is stored as the "musical tone waveform data" of the musical tone generation timing information group of the musical tone generation timing information memory 16. Each of the settings of the start point, the loop point and whether to carry out a loop read-out are respectively copied in the "start point, "loop point" and "loop" of the musical tone generation timing information group of the musical tone generation timing information memory 16. In addition, the time of the storage starting point, in other words, zero, is stored as the "read-out start time" (Step S706). Further, the values of the variables that indicate the "time that has passed" are cleared, the counting up of these variables is begun (Step S708) and the storage starting (second storage mode) routine is terminated.

Figure 8:
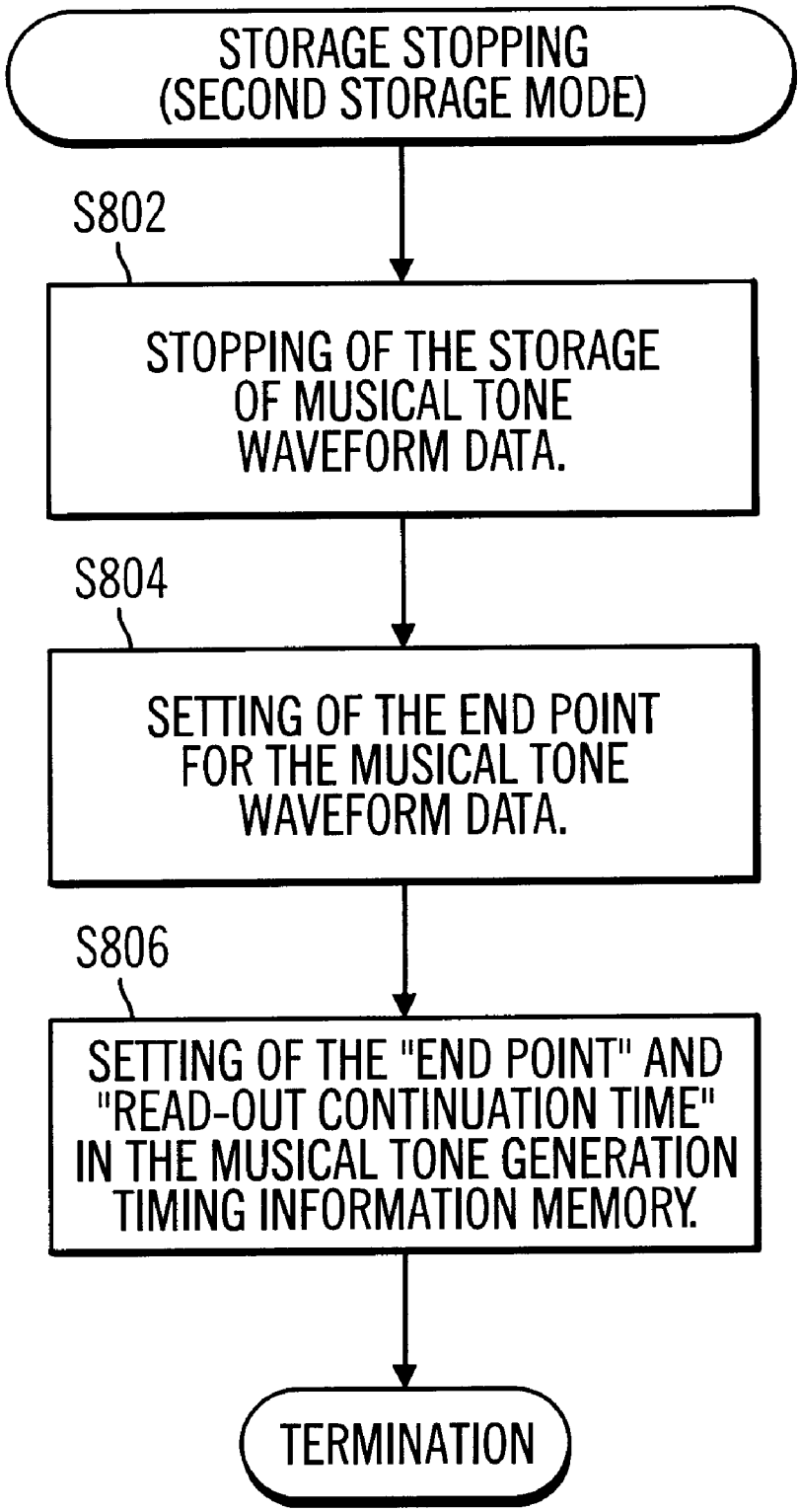
FIG. 8 is a flow chart for the storage stopping (second storage mode) routine.

Next, an explanation will be given concerning the process that is carried out when, during the storage of the second mode, the stopping (STOP) operator 46 has been operated, and the stopping of storage has been designated with reference to the flow chart for the storage stopping (second storage mode) routine that is shown in FIG. 8.

In the storage stopping (second storage mode) routine, the storage of the musical tone waveform data for the performance sounds that have been externally input in the waveform memory is stopped (Step S802), and the end point for the musical tone waveform data is set based on the difference between the final address and the first address in the waveform memory 18 for the musical tone waveform data the storage of which has been stopped (Step S804). In addition, the "end point" is stored in the musical tone generation timing information group of the musical tone generation timing information memory 16 and, in addition, the value that indicates the variable "time that has passed" is stored as the "read-out continuation time" in the musical tone generation timing information group of the musical tone generation timing information memory 16. In addition, the fact that only the initial musical tone generation timing information group has been stored in the musical tone generation timing information memory 16 is stored and the pad performance mode is reinstated. In the pad performance mode, by means of the operation of the other operator 48 on the operation panel 20, it is also possible to assign the musical tone waveform data that has been stored by the second storage mode to any pad 30 as desired.

Next, an explanation will be given of the processing in the reproduction mode. For the processing of the reproduction mode, the same processing is carried out as with the well known technology for automatic performance.

In other words, in the reproduction mode, the musical tone generation timing information is read out in order from the beginning to the end of the musical tone generation timing information memory 16 for each track in accordance with the start of the reproduction and the corresponding musical tone waveform data are read out based on the musical tone generation timing information that has been read out.

In accordance with the start of the reproduction, together with the setting of that point as the reference time and the starting of the measurement of the time, the first musical tone generation timing information group is made the object of the read-out. When the "read-out start time" of the musical tone generation timing information group that is the object of the read-out is in agreement with the measured time, the read-out of the musical tone waveform data which is corresponding to the "musical tone waveform data" of the musical tone generation timing information group that is the object of the read-out, is started. The read-out is started from the "start point" of the musical tone generation timing information group and, together with this, the measurement of the time that has passed from that point is begun.

If the time that has passed is in agreement with the "read-out continuation time" of the musical tone generation timing information group, the read-out of the musical tone waveform data that is being read out is stopped, wherein it waits for the read-out timing for the next musical tone generation timing information group. When it becomes the read-out timing, the same process is repeated.

When, in those cases where the data that indicate a loop read-out of the musical waveform data is to be carried out are stored in the "loop" of the musical tone generating timing information group, the read-out of the musical waveform data is carried out until the position that is corresponding to the "end point" of the musical tone generation timing information group and the read-out position of the musical tone waveform data is transferred to the position that is corresponding to the "loop point" of the musical tone generation timing information group. Then, in embodiments of this electronic musical instrument, by means of the operation of the track 1 (TR1) operator 32, the track 2 (TR2)

operator 34, the track 3 (TR3) operator 36 or the track 4 (TR4) operator 38 in the pad performance mode, the track is designated. With regard to the track that has been designated, it is possible to edit the stored contents of the musical tone generation timing information memory 16 by the operation of the other operator 48.

The editing items for the operators include "erase," "time cancellation," "copy," "insert" and "time and time change". With regard to "erase," a specific musical tone generation timing information group is designated, the musical tone generation timing information group that has been designated is erased and during the designated time for the musical tone generation timing information group that is to be erased, the read-out of the musical tone waveform data is not carried out. When "erase" is executed, the musical tone generation timing information group that has been designated is erased from the musical tone generation timing information memory 16 and all of the musical tone generation timing information groups that follow after the musical tone generation timing information group that is erased are moved forward and fill in by increments of 1. By means of this, it can be made so that the musical tone waveform data that are to be read out in the prescribed time are not read out.

Next, with regard to the "time cancellation," a specific musical tone generation timing information group is designated and the musical tone generation timing information group that has been designated is erased. When the "time cancellation" is executed, the musical tone generation timing information group that has been designated is erased from the musical tone generation timing information memory 16 and all of the musical tone generation timing information groups that follow after the musical tone generation timing information group that has been erased are moved forward and fill in by increments of 1 after "read-out start time" of all of the musical tone generation timing information groups that follow after the musical tone generation timing information group that has been erased being shifted forward only by the amount of the "read-out continuation time" of the musical tone generation timing information group that has been erased. By this means, an effect can be obtained that is the same as cutting out a portion of a tape on which a musical tone has been recorded and splicing together the tape before and after the part that has been cut out.

Next, with regard to "copy," a specific musical tone generation timing information group is designated and a musical tone generation timing information group that is the same as the musical tone generation timing information group that has been designated is copied in a time that has been designated. When "copy" is executed, the musical tone generation timing information group that is the same as the musical tone generation timing information group that has been designated is written to and stored in the position of the time that has been designated of the musical tone generation timing information memory 16. At this time, the "read-out start time" becomes the designated time.

With regard to "insert," a specific musical tone generation timing information group is designated and a musical tone generation timing information group that is the same as the musical tone generation timing information group that has been designated is inserted in a designated time. When "insert" is executed, the musical tone generation timing information group that is the same as the musical tone generation timing information group that has been designated is inserted and stored in the position of the time that has been designated in the musical tone generation timing information memory 16. In other words, of all of the musical tone generation timing information groups that follow after the musical tone generation timing information group that is to be inserted and stored are moved back in increments of 1 after the "read-out start time" of all of musical tone generation timing information groups that follow after the musical tone generation timing information group that is to be inserted and stored being shifted back only by the amount of the "read-out continuation time" of the musical tone generation timing information group that is to be inserted and stored. The musical tone generation timing information group that has been made the object of insertion in which the "read-out start time" is the insertion time that has been designated is stored in an empty location. By this means, an effect can be obtained that is the same as cutting out a portion of a tape on which a musical tone has been recorded, inserting a different tape on which a musical tone has been stored in the location that has been cut out and splicing it to the tape before and after it.

With regard to "time and time change," a specific musical tone generation timing information group is designated and the "read-out start time" and "read-out continuation time" of the musical tone generation timing information group that has been designated are changed. By this means, it is possible to change the read-out timing and the stop timing of the musical tone waveform data.

When the editing of the stored contents of the musical tone generation timing information memory 16 is directed, the stored content of the musical tone generation timing information memory 16 are displayed on the screen display device 50 such as that shown in FIG. 3. Therefore, the user designates the musical tone generation timing information that is the object of the editing while viewing the screen display of the screen display device 50. At this time, it is possible to designate one musical tone generation timing information group and it is also possible to designate a consecutive plurality of musical tone generation timing information groups. Following this, the editing is carried out by selecting any of the editing items.

As has been explained above, by means of this embodiment, by the operation of a pad 30 in the first storage mode, the musical tone waveform data that correspond to the pad 30 that has been operated are read out from the waveform memory 18 and a musical tone signal is produced. Together with this, the musical tone generation timing information that indicates the generation timing for the musical tone signal is stored in the musical tone generation timing information memory 16.

In addition, in the second storage mode, the performance sounds that have been externally input are stored as musical tone waveform data in the waveform memory 18 and, together with this, the musical tone generation timing information that indicates the storage timing for the musical tone waveform data is stored. At this time, the musical tone generation timing information that is stored is in the same format both in the case of the storage of a pad 30 performance and in the case of the storage of external performance sounds.

In addition, in each of the storage modes, the first storage mode and the second storage mode, in those cases where there are tracks on which the musical tone generation timing information has previously been stored, it is possible, while reproducing the stored information to store musical tone generation timing information on another track synchronously with the reproduction. As such, in the reproduction mode, the musical tone generation timing information of the four tracks that have been stored in this manner are reproduced synchronously with each other and the corresponding musical tones are produced. Thus, pad 30 performances can be stored to all of the tracks and these can be reproduced synchronously with each other. Further, an external source performance sounds can be stored to all of the tracks, and reproduced synchronously with each other or, together with the storage of pad 30 performances on certain of the tracks, performance sounds from an external source can be stored on other tracks, and reproduced synchronously with each other.

In addition, for the user, by only designating which of two types of storage modes to use for the storage, it is possible to store both performances by the pads 30 and performance sounds from outside in the same manner. The operation is simple and easy to understand.

In the case of the reproduction of a pad 30 performance as well as in the case of the reproduction of performance sounds from outside, because the reproduction is carried out by means of the same process, it is possible to make the processing concise and the load on the CPU 10 can be greatly reduced.

Further, because both the musical tone generation timing information that has been stored by means of the pad 30 operation and the musical tone generation timing information that has been stored by means of the input of performance sounds from outside are information that is in the same format, the user can carry out editing after storage without paying attention to what the method was used for storage. As such, the editing operation has been simplified.

The embodiment that has been described above may be modified as shown below.

(1) In the embodiment that has been described above, it is designed so that the read-out start time and the read-out stop time for the musical tone waveform data are set by the "readout start time" and the "read-out continuation time" of the musical tone generation timing information group. However, it is not limited to this and as long as the read-out start time and the read-out stop time are set, any management format may be employed as a matter of course.

For example, instead of the "read-out continuation time," a "read-out stop time" may be established that indicates the stopping time of the read-out. In this case, the musical tone generation timing information that designates the starting of the read-out of the musical tone waveform data and the musical tone generation timing information that designates the stopping of the read-out may be defined separately.

In addition, in the embodiment that is described above, as in the "read-out start time," it is designed so that a common specified time is made the reference for all of the musical tone generation timing information and the timing is regulated based on the passage of time from this time that had been made the reference. However, it is not limited to this and the timing may be regulated as a matter of course based on the time differences between each of the musical tone generation timing information groups. For example, instead of the "read-out start time," a "time difference" may be established that indicates the time difference from the immediately preceding musical tone generation timing information group.

(2) In the embodiment that is described above, the accuracy of the time management for the musical tone generation timing information is not specifically addressed. However, the time may be managed with a fixed value, for example, 1 msec, as the minimum unit. Additionally, the time management may also be carried out with a time interval that is in accordance with a designated performance tempo, for example, 1/96 of a quarter note, as the minimum unit. In those cases where the time management is by a time interval in accordance with the designated performance tempo, the accuracy of the time management changes in response to the designated performance tempo.

(3) In the embodiment that is described above, only the storage of the musical tone generation timing information from the time of the beginning, in accordance with the start of the storage, has been shown. However, it is not limited to this and the storage of the musical tone generation timing information may, as a matter of course, be done from any time desired in accordance with the start of the storage. For example, it may be set up so that any time desired that is a specified passage of time from the beginning is designated and the storage of the musical tone generation timing information is started from the designated time. This is done in the same manner when the storage is of performance sounds from an external source and, in this case, the storage of the musical tone generation timing information group is done with the "read-out start time" made the designated time.

In those cases where, at this time, the musical tone generation timing information has previously been stored in the musical tone generation timing information memory 16, the storage of new musical tone generation timing information may be done after erasing the musical tone generation timing information that was already stored. It may also be done letting the previous musical tone generation timing information groups that direct the read-out of the musical tone waveform data in a time other than designated for the read-out of the musical tone waveform data by the new musical tone generation timing information remain in the musical tone generation timing information memory 16.

In addition, in the latter case, with regard to the musical tone generation timing information groups that have been previously stored, of which the read-out stop time that is determined by the "read-out time" and the "read-out continuation time" being made prior to the storage start time that has been designated, the stored contents are left without change in the musical tone generation timing information memory 16. With regard to the musical tone generation timing information groups that have been previously stored, of which the "read-out start time" being made prior to the storage start time and the read-out stop time being made later than the storage start time, the "read-out continuation time" is changed to be shorter so that the read-out stop time is in agreement with the storage start time. In addition, following that, musical tone generation timing information from the new performance is stored.

By means of carrying out this kind of processing, it is possible to leave musical tone generation timing information in which the read-out of the musical tone waveform data is designated at a time that is prior to the storage start time. In the same manner, it is possible to leave musical tone generation timing information in which the read-out of the musical tone waveform data is designated at a time that is later than the time of the stopping of the storage.

In addition, by doing it in this manner, in the reproduction mode, it is possible to readout the musical tone waveform data that are designated by the musical tone generation timing information that has been previously stored prior to the designated storage start time and to read-out the musical tone waveform data that are designated by the musical tone generation timing information that has been newly stored at the designated and subsequent times.

It is possible to carry out a new storage no matter whether the musical tone generation timing information that has been stored before is something that is from a pad 30 performance or is from performance sounds from an external source. Thus, the musical tone signals that are produced in the reproduction mode can be made up of ones in which those that are prior to an arbitrary time are from a pad 30 performance and those that are later than an arbitrary time are from performance sounds from an external source or the reverse where those that are prior to an arbitrary time are from performance sounds from an external source and those that are later than an arbitrary time are from a pad 30 performance.

In addition, at the time of the storage of performance sounds from an external source, it may be designed so that the storage can only be carried out between an arbitrary storage start time and an arbitrary storage stop time. At times other than the arbitrary start and stop times, the reproduction of musical tone generation timing information that has previously been stored is carried out. In this case, it may be set so that the start of the reproduction of musical tone generation timing information can be from an arbitrary time that is prior to the storage start time and the reproduction of the musical tone generation timing information that has been stored previously is carried out in the period from an arbitrary reproduction start time to the storage start time, the storage of performance sounds from an external source is carried out in the period from the storage start time to the storage stop time and the reproduction of the musical tone generation timing information that has previously been stored is again carried out following the storage stop time. When it is done in this manner, the so-called "auto punch-in/auto punch-out recording can be carried out.

(4) In the embodiment that has been described above, it is set up so that the storage is started on the occasion of the operation of the starting (START) operator 44 after the first storage mode or the second storage mode has been entered. However, it is not limited to this and it may also be set as a matter of course so that the storage is started with another occasion.

For example, it may be set so that on the occasion of the passage of a specified period of time from the entry into the first storage mode or the second storage mode, the storage is automatically started. In this case, together with making the specified time a time that corresponds to a specified number of bars in accordance with the tempo or the rhythm that has been set in advance, it may be designed so that the period of the specified time is the number of metronome beats that are sounded which correspond to the tempo or rhythm that is set in advance. Or, it may be designed so that the storage is started on the occasion of the pressing and operation of any of the pads 30 after the first storage mode or the second storage mode have been entered.

Additionally, it may be designed so that the storage is started on the occasion of the level of the performance sounds that are input from outside rising above a specified level after the first storage mode or the second storage mode have been entered. In this case, a plurality of storage regions having a specified capacity are used in a ring form and the performance sounds are repetitively stored successively in the storage regions starting before the performance sounds rise above a specified level. When the performance sounds rise above a specified level, the storage is begun in the original storage region for the performance sounds and, after the completion of the storage, the stored contents of the annular storage regions are connected in front of the stored contents of the original storage region. Together with this, it is set so that the "read-out start time" that has been stored in the musical tone generation timing information is shifted forward only the amount of the storage time of the annular storage regions. By shifting it in this manner, the storage of the performance sounds can be done from a point that is a specified time prior to the rise above a specified level of the performance sounds and the missing of storage of the portion in which the performance sounds rise up can be prevented.

(5) In the embodiment that has been described above, it is designed so that the performance sounds that are input from an external source are stored as musical tone waveform data as they are, unchanged. However, it is not limited to this and it may be set so that some sort of processing such as a reverb effect or a chorus effect is appended to the performance sounds that have been input and this is stored as the musical tone waveform data.

(6) In the embodiment that has been described above, it is designed so that one preferred system includes such things as a performance means (pad 30) for carrying out the performance, a means in which the musical tone generation timing information is stored (musical tone generation timing information memory 16) and a means in which the musical tone signal is produced (CPU 10). However, these may be configured as separate systems and connected by a communications means such as a MIDI. For example, it may be designed so that the note numbers of the note-on message and the note-off message, which are the performance information for the MIDI, are attached correspondingly to the musical tone waveform data and the read-out of the musical tone waveform data that are based on and correspond to the note-on message and the note-off message which are supplied from other outside electronic musical instruments through the MIDI is controlled. Together with this, the corresponding musical tone generation timing information is stored.

It may also be designed so that the means in which the musical tone signal is generated in accordance with a pad 30 performance by a performer or the reproduction of the musical tone generation timing information that has been stored by means of a pad 30 performance is not provided inside the system and may be established externally. In this case, together with the production of the musical tone from the pad 30 performance by the external musical tone generation system, the musical tone generation timing information that has been stored from the pad 30 performance may be supplied to an external musical tone signal generation system through the MIDI, and the musical tone signal may be produced in response to the musical tone generation timing information.

(7) In the embodiment that has been described above, it is designed so that the production of the musical tone signal is by the read-out of the musical tone waveform data that is stored in the waveform memory 18 in accordance with a pad 30 performance by a performer or the reproduction of the musical tone generation timing information that has been stored by the pad 30 performance. However, the production of the musical tone signal may be done by other methods.

(8) In the embodiment that has been described above, it is possible to only store to one track at the same time, but it may be designed so that there can be storage to a plurality of tracks at the same time. In this case, it may be designed so that the storage to each track is designated to be in either the first storage mode or the second storage mode.

(9) In the embodiment that has been described above and in the (1) through (8), it is possible, as a matter of course, to suitably combine all of the varieties of illustrated modifications for which explanations have been given.

Although the foregoing described the invention with preferred embodiments, this is not intended to limit the invention. Rather, the foregoing is intended to cover all modifications and alternative constructions falling within the spirit and scope of the invention as expressed in the appended claims.

What is claimed is:

1. An electronic musical instrument having an input means for receiving external musical tone signals, comprising:

musical tone waveform data storage means in which musical tone waveform data is stored, and read-out locations are established that correspond to the musical tone waveform data;

a performance information generation means in which performance information corresponding to particular musical tone waveform data is generated from user stimuli or from external electronic musical instruments, the performance information indicating a production time and stopping time of musical tones;

musical tone generation timing information storage means in which musical tone generation timing information is stored, the musical tone generation timing information indicating musical tone waveform data to be read out, read-out locations of the musical tone waveform data, and read-out timing of the musical tone waveform data;

a first storage control means for storing first musical tone generation timing information in the musical tone generation timing information storage means in accordance with the generated performance information, the first musical tone generation timing information indicating first musical tone waveform data corresponding to the performance information, read-out locations of the first musical tone waveform data, and read-out timing of the first musical tone waveform data;

a second storage control means for storing second musical tone waveform data in the musical tone waveform data storage means in accordance with the external musical tone signals, for storing second musical tone generation timing information in the musical tone generation timing information storage means, and for establishing read-out locations of the second musical tone waveform data, the second musical tone generation timing information indicating second musical tone waveform data corresponding to the external musical tone signals, read-out locations of the second musical tone waveform data, and read-out timing of the second musical tone waveform data;

a reproduction means in which the first and second musical tone generation timing information stored in the musical tone generation timing information storage means is reproduced in a timing order indicated by the first and second musical tone generation timing information; and a musical tone production means in which, by reading out the musical tone waveform data corresponding to the external musical tone signal stored in the musical tone waveform data storage means indicated by the second musical tone generation timing information reproduced by the reproduction means and based on the read-out locations indicated by the second musical tone generation timing information, a musical tone signal is produced that corresponds to the external musical tone signal;

wherein the musical tone production means produces a musical tone signal by reading out musical tone waveform data corresponding to the performance information stored in the musical tone waveform data storage means and based on the established read-out locations of the musical tone waveform data, and produces a musical tone signal in response to the reproduction of the first musical tone generation timing information by reading out musical tone waveform data indicated by the first musical tone generation timing information and based on the read-out locations indicated by the first musical tone generation timing information.

2. The electronic musical instrument as recited in claim 1, wherein the musical tone generation timing information storage means comprises a plurality of tracks, the electronic musical instrument further including:

a track designation means in which a first track is designated for the storage of the musical tone generation timing information by the first storage control means or the second storage control means; and wherein in the reproduction means, musical tone generation timing information from a second track that differs from the first track is reproduced.

3. An electronic musical instrument as recited in claim 1, wherein the musical tone generation timing information storage means comprises a plurality of tracks, the electronic musical instrument further including:

a storage mode designation means in which either a first storage mode or a second storage mode is designated;

a track designation means in which a third track and a fourth track are designated for the storage of the musical tone generation timing information;

wherein when the first storage mode has been designated, the musical tone generation timing information is stored in the third track by the first storage control means;

wherein when the second storage mode has been designated, together with the storage of the musical waveform data in the musical tone waveform data storage means, the musical tone generation timing information is stored in the fourth track by the second storage control means; and wherein in the reproduction means, the musical tone generation timing information that has been stored in the third track and the fourth track are reproduced synchronously with each other.

4. The electronic musical instrument as recited in claim 1, wherein in the second storage control means, storage is started from an arbitrarily designated storage timing and, in accordance with the storage of the musical tone waveform data based on the external musical tone signal, musical tone generation timing information corresponding to the arbitrarily designated storage timing is stored in the musical tone generation timing information storage means.

5. An electronic musical instrument as recited in claim 1, wherein the at least one read-out location comprises a start point for designating a starting location for the read-out of musical tone waveform data.

6. An electronic musical instrument as recited in claim 1, wherein the at least one read-out location comprises locations for loop reading.

7. An electronic musical instrument having an input device for receiving external musical tone signals, comprising:

a musical tone waveform data memory for storing musical tone waveform data;

a processor programmed for establishing read-out locations that correspond to the musical tone waveform data, and for generating performance information corresponding to particular musical tone waveform data from user stimuli or from external electronic musical instruments, the performance information indicating a production time and stopping time of musical tones; and a musical tone generation timing information memory for storing musical tone generation timing information, the musical tone generation timing information indicating musical tone waveform data to be read out, read-out locations of the musical tone waveform data, and read-out timing of the musical tone waveform data;

wherein the processor is further programmed for storing first musical tone generation timing information in the musical tone generation timing information memory in accordance with the generated performance information, the first musical tone generation timing information indicating first musical tone waveform data corresponding to the performance information, read-out locations of the first musical tone waveform data, and read-out timing of the first musical tone waveform data, storing second musical tone waveform data in the musical tone waveform data memory in accordance with the external musical tone signals, storing second musical tone generation timing information in the musical tone generation timing information memory, and establishing read-out locations of the second musical tone waveform data, the second musical tone generation timing information indicating second musical tone waveform data corresponding to the external musical tone signals, read-out locations of the second musical tone waveform data, and read-out timing of the second musical tone waveform data, reproducing the first and second musical tone generation timing information stored in the musical tone generation timing information memory in a timing order indicated by the first and second musical tone generation timing information, producing a musical tone signal that corresponds to the external musical tone signal by reading out the musical tone waveform data corresponding to the external musical tone signal stored in the musical tone waveform data memory indicated by the second musical tone generation timing information reproduced by the processor and based on the readout locations indicated by the second musical tone generation timing information, and producing a musical tone signal by reading out musical tone waveform data corresponding to the performance information stored in the musical tone waveform data memory and based on the established read-out locations of the musical tone waveform data, and for producing a musical tone signal in response to the reproduction of the first musical tone generation timing information by reading out musical tone waveform data indicated by the first musical tone generation timing information and based on the read-out locations indicated by the first musical tone generation timing information.

8. The electronic musical instrument as recited in claim 7:

wherein the musical tone generation timing information memory comprises a plurality of tracks; and wherein the processor is further programmed for designating a first track for the storage of the musical tone generation timing information by the processor, and for reproducing musical tone generation timing information from a second track that differs from the first track.

9. An electronic musical instrument as recited in claim 7, herein the musical tone generation timing information memory comprises a plurality of tracks, the processor further programmed for:

designating either a first storage mode or a second storage mode;

designating a third track and a fourth track for the storage of the musical tone generation timing information;

storing the musical tone generation timing information in the third track when the first storage mode has been designated;

together with the storage of the musical waveform data in the musical tone waveform data memory, storing the musical tone generation timing information in the fourth track when the second storage mode has been designated; and synchronously reproducing the musical tone generation timing information that has been stored in the third track and fourth track.

10. An electronic musical instrument as recited in claim 7, the processor further programmed for starting storage from an arbitrarily designated storage timing and, in accordance with the storage of the second musical tone waveform data based on the external musical tone signal, second musical tone generation timing information corresponding to the arbitrarily designated storage timing is stored in the musical tone generation timing information memory.

11. An electronic musical instrument as recited in claim 7, wherein the at least one read-out location comprises a start point for designating a starting location for the read-out of musical tone waveform data.

12. An electronic musical instrument as recited in claim 7, wherein the at least one read-out location comprises locations for loop reading.

* * * * *